US005452855A

United States Patent [19]

Keller

[11] Patent Number: 5,452,855

[45] Date of Patent: Sep. 26, 1995

[54] HIGH VOLUME/LOW PRESSURE SPRAY GUN

[75] Inventor: Edward E. Keller, San Diego, Calif.

[73] Assignee: Hughes Aircraft Company, Los Angeles, Calif.

[21] Appl. No.: 432,279

[22] Filed: Nov. 6, 1989

[51] Int. Cl.[6] ..... B05B 1/24; B05B 7/12

[52] U.S. Cl. ..... 239/135; 239/290; 239/415

[58] Field of Search ..... 239/128, 132, 239/133, 135, 398, 434.5, DIG. 14, 415, 290; 118/300; 427/421; 62/5

[56] References Cited

U.S. PATENT DOCUMENTS

| | | | |
|---|---|---|---|
| 2,942,787 | 6/1960 | Bok et al. | 239/128 |
| 3,018,968 | 1/1962 | Levey | 239/128 |
| 3,208,229 | 9/1965 | Fulton | 62/5 |
| 3,219,027 | 11/1965 | Roche | 239/132 |
| 3,219,274 | 11/1965 | Roche | 239/133 |
| 3,796,376 | 3/1974 | Farnsteiner | 239/415 |
| 4,911,365 | 3/1990 | Thiel et al. | 239/296 |
| 5,265,801 | 11/1993 | Larson | 239/13 |

FOREIGN PATENT DOCUMENTS

| | | | |
|---|---|---|---|
| 0803984 | 2/1981 | U.S.S.R. | 239/527 |

*Primary Examiner*—Andres Kashnikow
*Attorney, Agent, or Firm*—R. M. Heald; Charles D. Brown; Wanda K. Denson-Low

[57] ABSTRACT

An improved high volume/low pressure spray gun for spraying liquids such as paint. The spray gun includes a nozzle for mixing a liquid, such as paint in a solvent carrier, with a higher-than-atmospheric pressure gas, such as compressed air, and projecting the mixture towards the surface to be coated. The liquid is conveyed to the nozzle through a tube. A valve, ordinarily operated by a manual trigger, turns liquid flow on or off. Compressed air is conveyed through a hose to a vortex tube, then from the vortex tube to the nozzle. The vortex tube receives compressed gas at a selected temperature, ordinarily room temperature, and divides it into a high volume warm stream sent to the nozzle and a cool stream which is ordinarily exhausted to the atmosphere. The resulting high volume, low pressure, warm propellant air produces improved painting quality with less overspray.

14 Claims, 3 Drawing Sheets

HIGH VOLUME/LOW PRESSURE SPRAY GUN

BACKGROUND OF THE INVENTION

This invention relates in general to spray guns and, more specifically, to an improved high volume/low pressure warm output spray gun of improved efficiency.

Spray guns in which compressed air is mixed with a liquid, atomizing the liquid and projecting it as very small droplets against a surface to be coated have been in widespread use for very many years. Typically, spray guns are used for painting, application of pesticides and the like.

Due to environmental concerns, greater importance is being given to paint spray systems which use less solvent, reduce overspray and migration and generate fewer emissions and pollutants providing a cleaner, safer environment for workers. In addition, reduced overspray results in cost savings.

Conventional and electrostatic air spray systems typically use air pressure ranging from 30 to 90 psi. As compressed air exits the gun nozzle, it suddenly expands as it returns to atmospheric conditions. While this sudden expansion aids atomization, this "exploding" or "blasting" effect propels the paint droplets at high velocity, causing overspray and bounce-back. Paint "fog" often occurs, making it difficult for the painter to see his work. In masked painting, this high spray velocity may force paint under the maskant, causing rejection or extra re-work. Overspray results in wasted material, contamination of spray booth filters and increased requirements for cleaning spray booths. Typical of these conventional spray guns are those disclosed by Bramsen, et al in U.S. Pat. No. 1,797,209 and Sykes in U.S. Pat. No 2,888,207.

Two different approaches to this problem have recently been developed. One uses a turbine compressor to produce a high volume of low pressure, warm air to the spray gun, while the other uses a venturi to draw in and mix outside air in the region of this spray gun with high pressure compressed air to provide a greater volume of lower pressure air to the spray gun.

Typical of the turbine systems is that described by Muck in U.S. Pat. No. 4,565,488 and available from the Bessam-Aire Company under the Accuspray BE-80 designation. A turbine provides warm air to a spray gun at 7 psi or less. While these sytems are effective in reducing overspray and paint bounce-back, they are relatively expensive since a fixed or cart mounted turbine for each one or two spray guns is required. Also, temperature and pressure of the air going into the spray gun is difficult to adjust and the warm air going through a long air hose may cool before reaching the spray gun.

In another approach, a venturi is used in the air line to the spray gun, either in or near the gun handle. Such a system is described by Farnsteiner in U.S. Pat. No. 3,796,376. High pressure air is directed through the venturi pulling in and mixing a large volume of ambient air while reducing pressure. Venturi systems are available, for example, from the Lex-Aire Co. While these systems reduce paint mist and overspray, several problems remain. They are incapable of warming the air entering the spray gun and will, if anything, cool the air. Also, since ambient air is pulled in from adjacent the spray gun, any paint mist remaining will be pulled into the gun. The filters used to removed paint mist, dust or the like will tend to clog, gradually reducing the quantity of outside air, changing the air-to-paint ratio, making uniform paint application difficult.

Thus, there is a continuing need for improved high volume, low pressure, spraying systems which are lightweight, convenient and economical.

SUMMARY OF THE INVENTION

The above-noted problems, and others are overcome by a spraying system which uses a vortex tube to direct warm, low pressure/high volume air to a basically conventional spray gun.

A typical spray gun includes a nozzle for mixing the liquid to be sprayed, such as paint, pesticides or the like, a tube for directing the liquid to the nozzle and a hose for directing higher-than-atmospheric pressure gas, such as compressed air, to the nozzle. For convenience, the liquid being sprayed will be referred to as "paint" and the propelling gas as "air", it being understood that other liquids and gases may be used.

The improved results obtained result from the use of a vortex tube in the air line to receive a high pressure, room temperature, compressed air and pass a warmed, high volume/low pressure air stream to the gun.

Vortex tubes have been used for some time to supply a stream of cold (typically, –40 degrees F.) air for spot cooling of electronic components, parts being machined, soldered parts, closed circuit TV cameras and the like. A by-product of vortex tubes is a stream of warm low pressure air. I have discovered that the warm air output of a vortex tube produces excellent results when used as the air input stream to a spray gun. Vortex tubes are inexpensive, light in weight, have no moving parts, and excellent stream of low pressure air at a selected temperature above that of the input gas, which conveniently can be produced by a conventional air compression system, known in the industry as "shop air".

BRIEF DESCRIPTION OF THE DRAWING

Details of the invention, and of several embodiments thereof, will be further understood upon reference to this drawing, wherein.

DETAILED DESCRIPTION OF PREFERRED EMBODIMENTS

Figure 1:
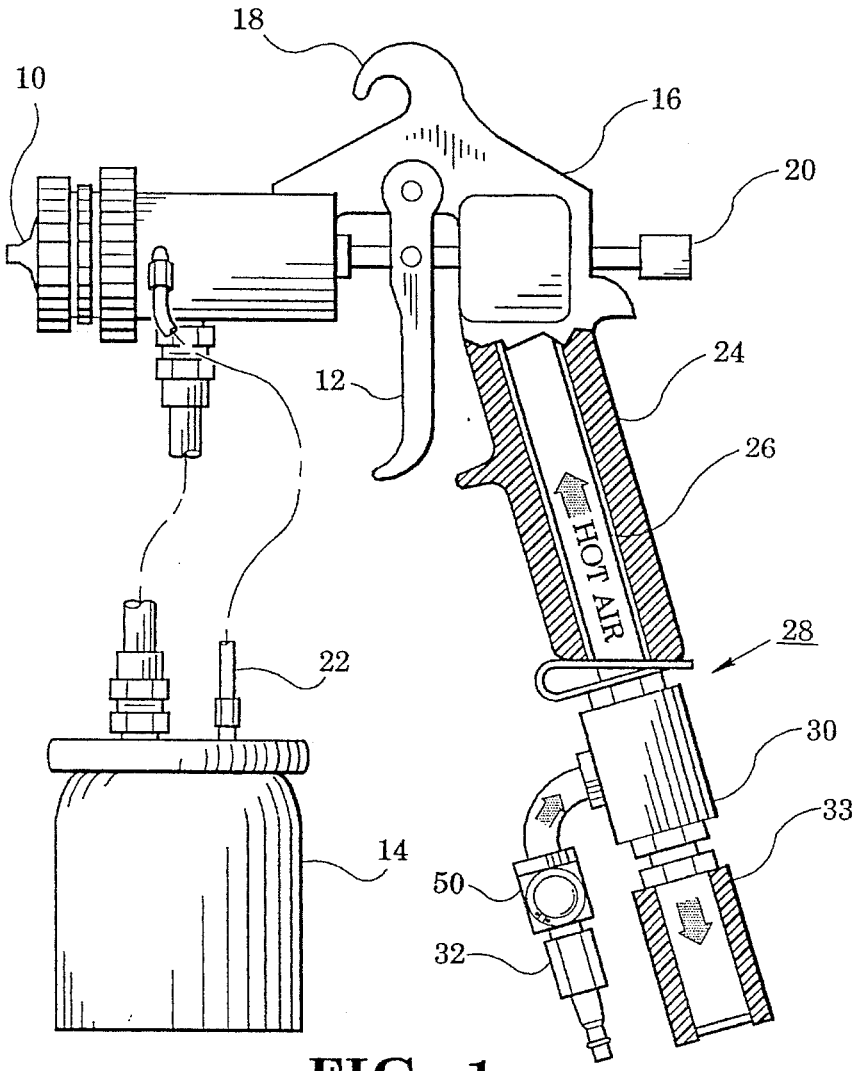
FIG. 1 is a schematic elevation view of a first embodiment of my spray gun which incorporates a vortex tube.

Referring now to FIG. 1, there is seen a schematic side or elevation view of the improved spray gun of my invention.

The basic paint spraying mechanism, utilizing nozzle 10, paint flow controlling trigger 12, paint container 14 and gun body 16 is conventional in design. Typically, these components could be similar to these described, for example, by Farnsteiner in U.S. Pat. No. 3,796,376 or those available for use with low pressure, high volume, air supply such as the turbine system described above. Typically, a hook 18 for hanging up the spray gun when not in use may be provided. A conventional, easily accessed, paint flow adjustment knob 20 may be provided. Paint container 14 is pressurized, typically to about 2–10 psig, through a tube 22 which uses the air pressure within nozzle 10.

In conventional spray guns, handle 24 simply contains a tube for conveying air from a source of high pressure air to nozzle 10. In this embodiment of my improved spray gun, I house the heat exchange tube 26 of a vortex tube 28 within handle 24.

Warm, low pressure air exits the upper end of tube 26 enroute to nozzle 10. The vortex generation chamber 30 of vortex tube 28 lies just outside handle 24. Cool air at higher pressure exits through porous muffler 33, to the atmosphere. In place of muffler 33, any suitable exhaust system such as a simple, long tube could be used. High pressure air, typically at 30 to 130 psig (or any other suitable gas) from a conventional compressor (not shown) enters chamber 30 through an inlet filter 32. This gun obtains an optimum combination of maximum transfer efficiency using a minimum of volatile solvents by the use of the low pressure/warm air produced by vortex tube 28.

Handle 24 may be formed from a plastic (as shown), aluminum, or any other suitable material. If handle 24 should be uncomfortably warm to the operator, a layer of porous foam insulation material may be wrapped around handle 24. A vortex tube 28 of the sort useful in the various spray gun embodiments described herein is further detailed in FIG. 2, which shows an axial section through the vortex tube.

In vortex tube 28, high pressure air enters vortex generator chamber 30, as indicated by arrow 34. Tangentically drilled holes 36 in annular inner wall 38 direct the air into heat exchange tube 26, causing the hot air stream to spin along 5 the inner wall of tube as indicated by line 40. Holes or nozzles 36 are aimed so that the injected tangentically at the circumference of chamber 30. The resulting spinning air stream enters heat exchange tube 26 because the opening 41 to tube 26 is larger than the opposite opening 43. As the air passes through holes 36 it loses part of its pressure as it expands and gains sonic or near-sonic velocity. Centrifugal force keeps air stream 40 near the wall of tube 26 as it moves along the tube. This moving vortex achieves sonic speeds, up to 1,000,000 rpm. When the hot air stream reaches control valve 42 (typically a needlevalve), a portion is allowed to exit as indicated by arrow 44. The air that does not escape through valve 42 is forced back through the center of the sonic-velocity stream 40. This still spinning returning stream, indicated by line 46, moves back toward cold outlet 48.

Since the hot stream 40 did not occupy the center of tube 26, an ideal central path is available for cold stream 46 to follow.

Both stream 40 and 46 are rotating in the same direction at the same angular velocity. Intense turbulence at the boundary between the two streams and throughout both streams locks them into a single mass so far as rotational movement is concerned. Kinetic energy in the form of heat is transferred between the two streams, passing from the inner, cold, stream 46 to the outer, heated, stream 40.

By selecting entering air pressure, size of vortex generator chamber 30 and the length and diameter of heat exchange tube 26, temperatures at cold outlet 48 as low as –40 degrees Fahrenheit and at hot outlet valve 42 of 200 degrees Fahrenheit are possible. For the purposes of my invention, I prefer hot air stream temperatures in the range of about 110 to 140 degrees Fahrenheit at a pressure of about 1 to 10 psig. The overall size of the vortex tube and the compressed air entering inlet 32 are selected to provide the desired high volume at these pressures and temperatures. These parameters, of course, can be selected in accordance with the characteristics of the paint or other liquid being sprayed and the particular spray nozzle used.

Vortex tubes have been used for some time to provide cold air in applications such as cooling electronic controls, cooling machining operations, cooling soldered parts, setting hot melts and other cooling applications. The stream of hot gas ordinarily simply released to the atmosphere. Typical cooling vortex tubes are available from the Exair Corporation.

In my application, the hot air stream is used and the cold air stream is discarded. Generally, the cold air stream can be simply directed away from the operator and dumped to atmosphere.

If the exiting cold air stream produces sufficient noise to be annoying, a conventional muffler can be used. In most cases, the hot air stream will have a relatively high volume, low pressure and moderately elevated temperature. The cold air stream will generally be moderate volume, low pressure and quite low temperature.

Vortex tube air supply systems may be used with both "bleeder" and "non-bleeder" spray guns. For bleeder guns, when paint supply to the spray nozzle is shut off, entering air is directed to atmosphere and not turned off. In a "non-bleeder" type gun, the inlet air to the vortex gun would be cut off at the same time (or just after) paint supply is shut off to the spray nozzle, through a mechanical interconnect with the gun trigger.

Figure 2:
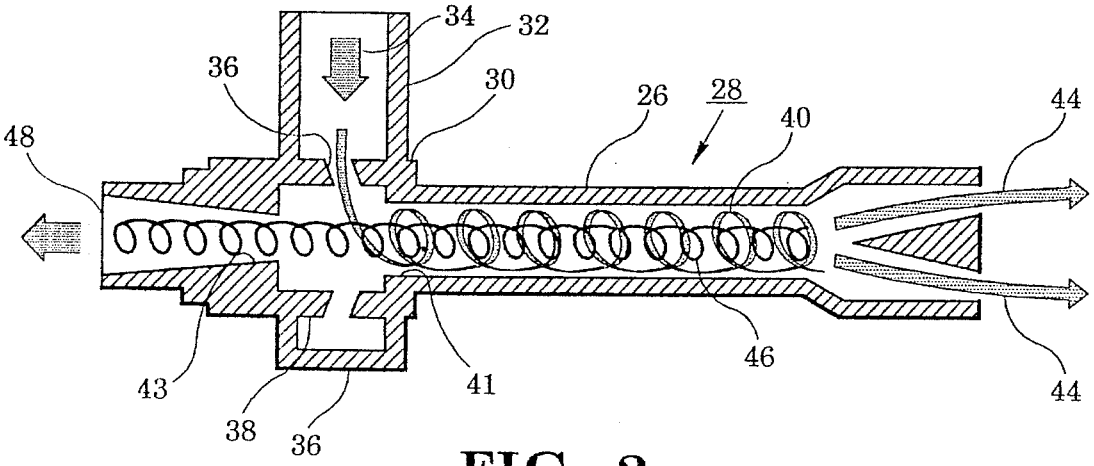
FIG. 2 is a schematic section view of the vortex tube of FIG. 1, taken on a vertical center line.
Figure 3:
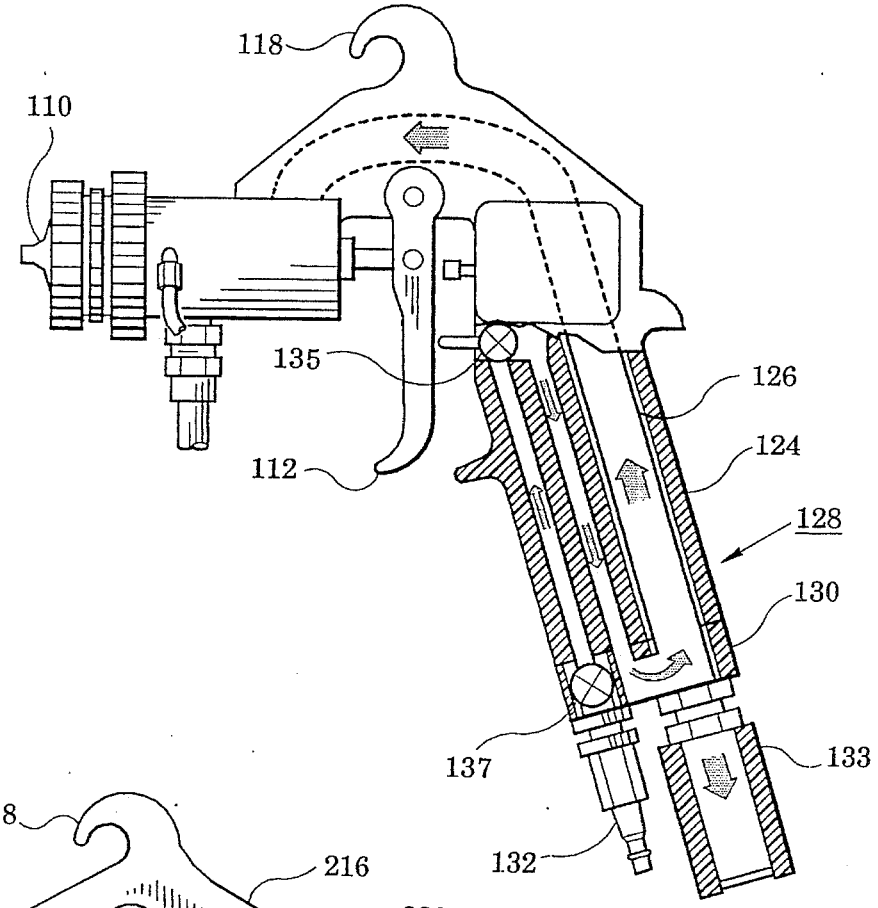
FIG. 3 is a schematic elevation view of a second embodiment of my spray gun.

A second embodiment of a spray gun using a vortex tube of the sort shown in FIG. 2 is shown in FIG. 3 in schematic side view, partially cut-away to show the vortex tube.

The spray gun uses a conventional nozzle 110 of the sort adapted to mix a low pressure/high volume, propellent gas such as air with a liquid to be sprayed and project the mixture toward an object to be coated. A valve 135 operated by trigger 112 turns the flow of paint through the vortex tube 128 and nozzle 110 on and off.

The heat exchange tube 126 of a vortex tube 128 extends up through the handle 124 of the spray gun, across above the gun body directly to nozzle 110. As in FIG. 1, the vortex tube includes a high pressure gas inlet 132, a vortex generator chamber 130 and a cold gas outlet muffler 133. A valve 137 selectively turns the air flow in the gun from tube 132 "on" or This embodiment has the advantage of compactness while permitting a longer heat transfer tube 126. Since tube 126 is warm, thermal insulation preferably surrounds tube 126 within handle 126. Or handle 126 can be fabricated from an insulating plastic material. If desired, a two-stage trigger arrangement may be used, to initially shut off paint flow, then shut off air flow. Since the heated air is produced at the spray gun in vortex tube 128, there is no need for continuous air flow to maintain input air temperature, as would be the case with a remote turbine system.

Figure 4:
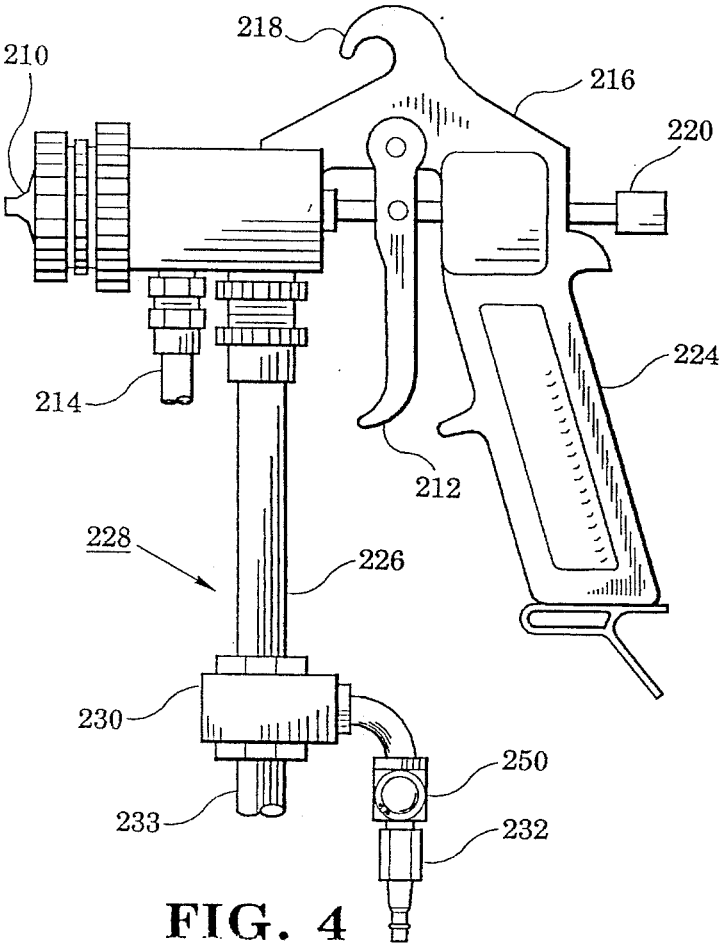
FIG. 4 is a schematic elevation view of a third embodiment of my spray gun.

Another embodiment of my improved spray gun is schematically illustrated in FIG. 4. Here, vortex tube 228 is connected directly to nozzle 210. As in FIG. 1, the spray gun itself is basically of conventional design, with a housing 216, handle 224, paint flow control valve trigger 212, adjustment knob 220 and paint delivery tube 214. Here, vortex tube 228 includes heat exchange tube 226, vortex generator chamber 230, and cold air outlet 233. High pressure air at inlet 232 passes through a valve 250, so that air supply can be easily shut off during breaks in painting.

The embodiment of FIG. 4 has advantages in ease of retrofit of existing spray guns, and in removing heat exchange tube 226 from handle 224, since in some cases tube 226 might heat the handle to a greater than desirable extent.

Figure 5:
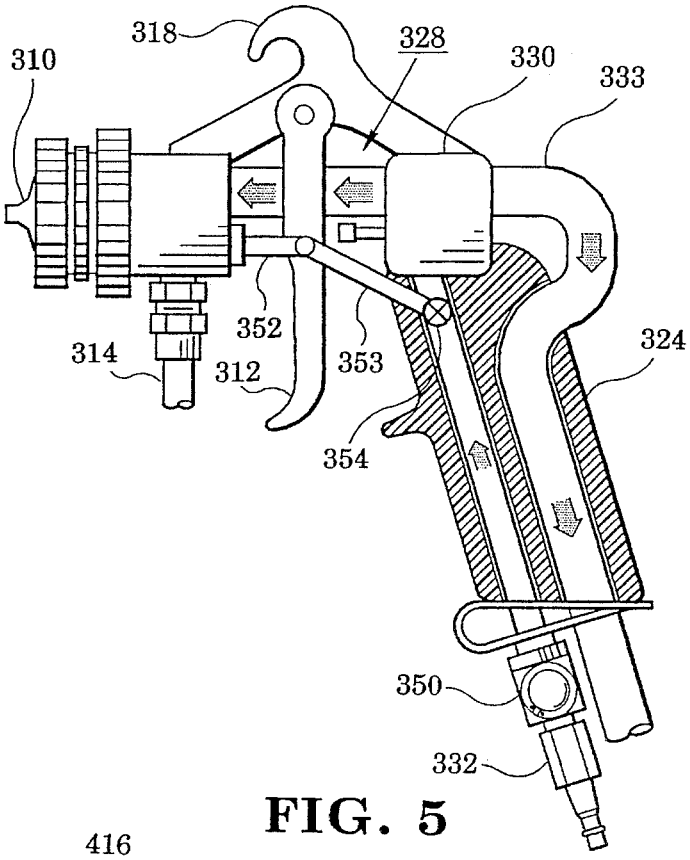
FIG. 5 is a schematic elevation view, partially cut away, of a fourth embodiment of my spray gun.

An embodiment in which the vortex tube is placed above the spray gun body is schematically illustrated in FIG. 5. Again, a conventional spray gun nozzle 310 is selected, of the sort adapted to mix paint or other liquid received from a pressure pot through tube 314 with low pressure, high volume air or other gas. Vortex tube 328 is arrayed along the top of the spray gun, delivering warm air from heat exchange tube 326 directly to nozzle 310. Vortex generator chamber 330 received high pressure air through inlet pipe 332 which passes through handle 324. Cold air is exhausted through tube 333, which, for convenience, may pass down through handle 324. A conventional valve controlled by trigger 312 turns paint flow on and off at nozzle 310 through link 352. If desired, a rearward link 353 may connect to a conventional valve 354 in the gas inlet line 332 to shut air flow off after paint flow is turned off and, conversely, turn air flow on just before paint flow is turned on. This is a practical approach, since the generation of warm air is closely adjacent to nozzle 310 so that no extended air "warm up" time is required.

The embodiment of FIG. 5 has advantages in directly connecting the warm air outlet of vortex tube 328 to nozzle 310 and having the vortex tube out of handle 324. Vortex tubes of different lengths can easily be accommodated in this version.

Figure 6:
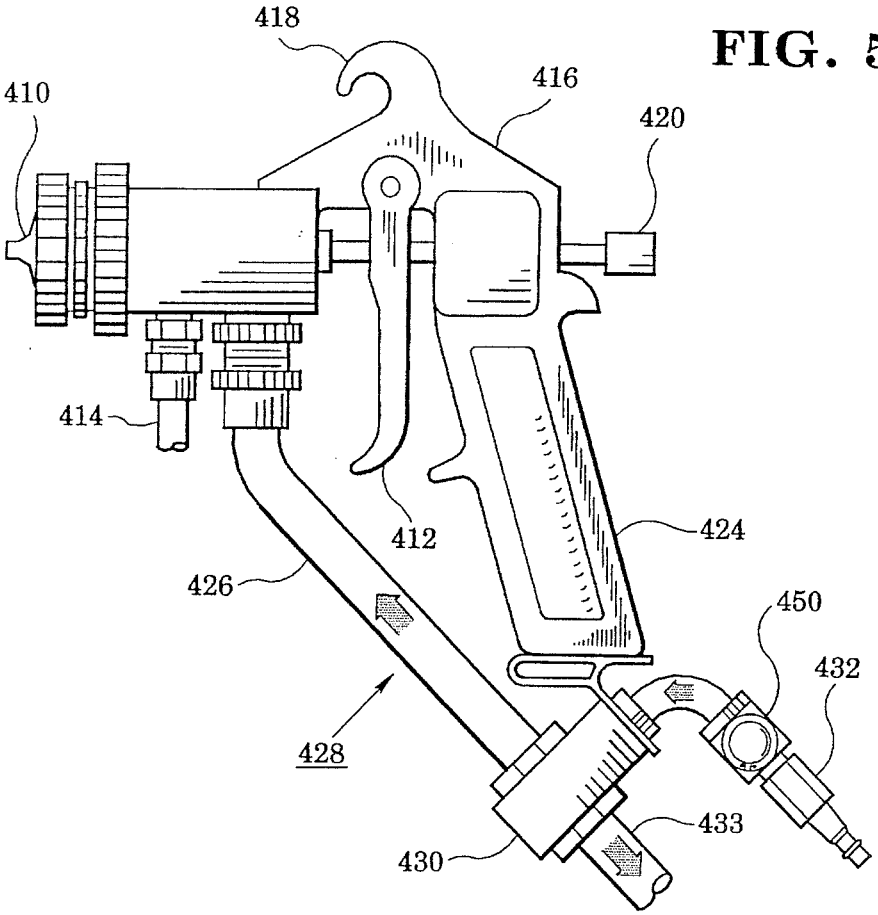
FIG. 6 is a schematic elevation view of a fifth embodiment of my spray gun.

Another embodiment of my improved spray gun is schematically illustrated in FIG. 6.

Here again, the primary spray gun components are conventional in nature. The basic spray gun includes a nozzle 410 for mixing paint and air and propelling them towards an object to be coated, a housing 416, a hook 418 for hanging up the gun, a handle 424, a trigger 412 for operating a paint flow controlling valve, a mixture control knob 420 and a tube 414 for admitting paint under pressure.

In this embodiment, high volume low pressure air is delivered to nozzle 410 by a vortex tube 428 fastened between the lower end of handle 424 and housing 416 adjacent to nozzle 410. Heat exchange tube 426 can directly introduce the warm air into the nozzle. Vortex generation chamber 430 is adjacent to handle 424 and out of the operator's way. Air enters through fitting 432 and valve 450 and cold air exits through tube 433.

The arrangement of FIG. 6 has advantages in that neither hot nor cold tubes pass through handle 424, so the that thermal insulation to protect the operator's hand from temperature extremes is not necessary. A fairly long heat exchange tube 426 can easily be accommodated.

While certain preferred arrangements and dimensions are specified in the above description of preferred embodiments, these can be varied, where suitable, with similar results. For example, the diameter and length of the heat exchange tube and vortex generation chamber can be selected to provide a selected combination of warm air pressure, volume and temperature. More than one vortex tube may be used to achieve features such as shorter vortex tubes for compact gun designers, higher flow rates, stepped flow rates and multiple temperature capability. If desired, the output orifice of the warm air outlet can be fixed or variable, such as by a conventional needle valve.

Other applications, variations and ramifications of this invention will become apparent to those skilled in the art upon reading this disclosure. These are intended to be included within the scope of this invention, as defined in the appended claims.

I claim:

1. In a paint spraying system which comprises:

a spray gun comprising:

a nozzle for mixing a liquid to be sprayed and a propellant gas and for directing said mixture towards a surface to be coated;

means for directing a stream of said liquid from a source to said nozzle without adding significant heat to said stream:

valve means for turning said liquid stream on and off;

handle means adjacent to said valve means having a support end for manually supporting the gun during use and an opposite free end; and means for directing a stream of compressed gas from a compressed gas source to said nozzle;

the improvement comprising:

interposing a vortex tube in said compressed gas stream between said source and said nozzle, said vortex tube having:

an inlet for receiving a compressed gas stream from said source;

a vortex chamber for creating a vortex in said incoming gas stream;

a first outlet extending into said handle for directing a high volume, low pressure, warm gas from said vortex chamber to said nozzle; and a second outlet adjacent to the free end of said handle for directing low volume cold gas out of said vortex tube to the atmosphere.

2. The improvement according to claim 1 further including an elongated tube connected to said second outlet for conveying said low temperature gas away from said gun.

3. The improvement according to claim 2 further including muffler means through which said low temperature gas from said vortex tube is passed.

4. The improvement according the claim 1 wherein said handle substantially encloses said vortex chamber with said first outlet extending toward, and terminating adjacent to, said nozzle, said handle further substantially enclosing means for diverting inlet gas to said vortex chamber and means for exhausting low temperature gas from said second outlet.

5. A spray gun for spraying a mixture of liquid and gas toward a structure to be coated with the liquid which comprises:

a nozzle for mixing a higher than atmospheric pressure gas and a liquid and directing said mixture toward a surface to be coated;

means for directing a stream of liquid from a reservoir to said nozzle without adding significant heat to said liquid;

a handle having a support end for supporting said nozzle and an opposite free end;

means for selectively interrupting said liquid stream;

a vortex tube having a high pressure gas receiving inlet, a first outlet extending into said handle for releasing high volume, warm, lower pressure but higher than atmospheric pressure gas, and a second outlet adjacent to the free end of said handle for releasing low volume cold gas;

means for directing a stream of compressed gas from a compressed gas source to said inlet; and means for directing said warm air from said first outlet to said nozzle for mixing with said liquid.

6. In a spray gun for spraying a mixture comprising liquid droplets entrained in a gas stream toward an object to be coated with the liquid which comprises:

a body;

a nozzle secured to said body, adapted to mix a higher than atmospheric pressure gas stream with a liquid and to direct the resulting mixture toward an object to be coated;

means for directing a stream of said liquid from a source to said nozzle without adding significant heat to said stream;

a handle having a support end secured to said body adapted to permit manual support and movement of said spray gun and an opposite free end;

a valve adjacent to said handle adapted to be manually moved between positions permitting and denying flow of gas to said nozzle; and inlet means adapted to receive pressurized gas from a source and directing said gas to said valve;

the improvement comprising:

a vortex tube interposed between said inlet means and said valve; said vortex tube comprising;

a vortex chamber adapted to receive said gas from said inlet and create a vortex in the gas stream;

a tube extending from said chamber to a first outlet extending into said handle for directing a high volume of warmed gas at a lower but above atmospheric pressure to said nozzle; and a second outlet adjacent to said free end of said handle for directing lower temperature gas out of said chamber.

7. The improvement according to claim 6 further including an elongated tube connected to said second outlet for conveying said low temperature gas away from said gun.

8. The improvement according to claim 7 further including muffler means through which said low temperature gas from said vortex tube is passed.

9. In a paint spraying system which comprises:

a spray gun comprising:

a nozzle for mixing a liquid to be sprayed and a propellant gas and for directing said mixture towards a surface to be coated;

means for directing a stream of said liquid from a source to said nozzle without adding significant heat to said stream:

valve means for turning said liquid stream on and off;

handle means adjacent to said valve means for manually supporting the gun during use; and means for directing a stream of compressed gas from a compressed gas source to said nozzle;

the improvement comprising:

interposing a vortex tube in said compressed gas stream between said source and said nozzle, said vortex tube located adjacent to said valve and handle with said first outlet connected to said gun adjacent to said nozzle said vortex tube having:

an inlet for receiving a compressed gas stream from said source;

a vortex chamber for creating a vortex in said incoming gas stream;

a first outlet for directing a high volume, low pressure, warm gas from said vortex chamber to said nozzle: and a second outlet for directing low volume cold gas out of said vortex tube to the atmosphere.

10. The improvement according to claim 9 further including an elongated tube connected to said second outlet for conveying said low temperature gas away from said gun.

11. The improvement according to claim 10 further including muffler means through which said low temperature gas from said vortex tube in passed.

12. In a spray gun for spraying a mixture comprising liquid droplets entrained in a gas stream toward an object to be coated with the liquid which comprises:

a body;

a nozzle secured to said body, adapted to mix a higher than atmospheric pressure gas stream with a liquid and to direct the resulting mixture toward an object to be coated;

means for directing a stream of said liquid from a source to said nozzle without adding significant heat to said stream;

a handle secured to said body adapted to permit manual support and movement of said spray gun;

a valve adjacent to said handle adapted to be manually moved between positions permitting and denying flow of gas to said nozzle; and inlet means adapted to receive pressurized gas from a source and directing said gas to said valve;

the improvement comprising:

a vortex tube interposed between said inlet means and said valve; said vortex tube comprising:

a vortex chamber adapted to receive said gas from said inlet and create a vortex in the gas stream;

a first outlet extending from said chamber to a first outlet for directing a high volume of warmed gas at a lower but above atmospheric pressure to said nozzle;

a second outlet for directing lower temperature gas out of said chamber; and said vortex tube located adjacent to said valve and handle with said first outlet connected to said spray gun adjacent to said nozzle.

13. The improvement according to claim 12 further including an elongated tube connected to said second outlet for conveying said low temperature gas away from said gun.

14. The improvement according to claim 13 further including muffler means through which said low temperature gas from said vortex tube is passed.

* * * * *